US011043154B1

(12) United States Patent
Xu et al.

(10) Patent No.: US 11,043,154 B1
(45) Date of Patent: Jun. 22, 2021

(54) SIGNAL PROCESSING METHOD FOR DISPLAY PANEL AND DEVICE USING SAME

(71) Applicant: TCL CHINA STAR OPTOELECTRONICS TECHNOLOGY CO., LTD., Shenzhen (CN)

(72) Inventors: Fengcheng Xu, Shenzhen (CN); Dan Cao, Shenzhen (CN); Mingjong Jou, Shenzhen (CN)

( * ) Notice: Subject to any disclaimer, the term of this patent is extended or adjusted under 35 U.S.C. 154(b) by 0 days.

(21) Appl. No.: 16/627,303

(22) PCT Filed: Dec. 16, 2019

(86) PCT No.: PCT/CN2019/125569

§ 371 (c)(1),
(2) Date: Dec. 29, 2019

(30) Foreign Application Priority Data

Dec. 2, 2019 (CN) ..... 201911210861.1

(51) Int. Cl.
*G09G 5/00* (2006.01)
*G09G 3/20* (2006.01)
*G09G 5/18* (2006.01)

(52) U.S. Cl.
CPC ..... *G09G 3/20* (2013.01); *G09G 5/18* (2013.01); *G09G 2310/08* (2013.01); *G09G 2370/08* (2013.01)

(58) Field of Classification Search
CPC ... G09G 3/20; G09G 5/18; G09G 5/00; G06F 3/038
See application file for complete search history.

(56) References Cited

U.S. PATENT DOCUMENTS

2008/0022179 A1* 1/2008 Lee ..... H04L 25/0288 714/748
2012/0146965 A1* 6/2012 Baek ..... G09G 3/006 345/204
2013/0283128 A1* 10/2013 Lee ..... G11C 29/56004 714/773
2014/0186029 A1 7/2014 Khoury et al.
2019/0197941 A1* 6/2019 Lim ..... G09G 3/20
2019/0371260 A1* 12/2019 Kim ..... G09G 3/3275

FOREIGN PATENT DOCUMENTS

CN 1146104 A 3/1997
CN 103516477 A 1/2014
CN 109698762 A 4/2019
CN 109787724 A 5/2019
WO 2011022886 A1 3/2011

* cited by examiner

*Primary Examiner* — Pegeman Karimi

(57) ABSTRACT

A signal processing method of a display panel and a device using same are provided. The method includes obtaining a bit error rate of each adjusted data to obtain multiple initial bit error rates; and selecting one of the initial bit error rates from the multiple initial bit error rates. The bit error rate is used as a feedback bit error rate; when the feedback bit error rate falls within a preset range, a current pre-emphasis coefficient is used as a target pre-emphasis coefficient, and a video signal is compensated according to the target pre-emphasis coefficient.

20 Claims, 4 Drawing Sheets

SIGNAL PROCESSING METHOD FOR DISPLAY PANEL AND DEVICE USING SAME

FIELD OF INVENTION

The present invention relates to the field of display technologies, and in particular, to a method and device for processing signals of a display panel.

BACKGROUND OF INVENTION

With increasing the size of the display panels, large-sized display products such as 65-inch, 75-inch, and even 85-inch are constantly popular in the market. As the size increased, the resolution of the panels is also increased, such as from high definition (HD) to full high definition (FHD), FHD to ultra definition (UD), and then to 8K.

However, when the size of the panels increased, more source driving chips are needed. A circuit board connected to the source driving chips is longer. The circuit board is connected to a control board (disposed with a timing control chip (Tcon)). The Tcon sends data to each source driver chip, and the far-end source driver chip has a longer transmission distance. When the resolution increased, an amount of data transmitted also increased, so that the data rate transmitted by the source driving chip (driver IC) also increased. However, signals with high transmission rates are prone to signal distortion during long-distance transmission, thereby reducing the display effect.

Therefore, it is necessary to provide a signal processing method of a display panel and a device thereof to solve the problems existing in the conventional art.

SUMMARY OF INVENTION

An object of the present invention is to provide a signal processing method of a display panel and a device using same, which can avoid signal distortion and improve the display effect.

To solve the above technical problems, the present invention provides a signal processing method of a display panel, wherein the display panel includes a source driving chip and a timing control chip, the timing control chip is configured to provide a video signal to the source driving chip, and the source driving chip is configured to provide a data signal to the display panel, and wherein the signal processing method includes:

when a test data is obtained, adjusting the test data by the source driving chip using each preset optimization coefficient according to a preset adjustment instruction to obtain multiple adjusted data, wherein the test data corresponds to a pre-emphasis coefficient;

obtaining a bit error rate of each adjusted data by the source driving chip, to obtain multiple initial bit error rates, selecting one of the initial bit error rates as a feedback bit error rate from the multiple initial bit error rates by the source driving chip, feedbacking the feedback bit error rate to the timing control chip by the source driving chip, determining whether the feedback bit error rate falls within a preset range or not by the timing control chip, and when the bit error rate exceeds the preset range, adjusting a current pre-emphasis coefficient by the timing control chip, and returning to and executing the step of when the test data is obtained, adjusting the test data by the source driving chip using each preset optimization coefficient according to the preset adjustment instruction to obtain the multiple adjusted data;

when the feedback bit error rate falls within the preset range, using the current pre-emphasis coefficient as a target pre-emphasis coefficient, and compensating the video signal according to the target pre-emphasis coefficient to obtain a compensation signal by the timing control chip; and when the feedback bit error rate falls within the preset range, using the preset optimization coefficient corresponding to the feedback bit error rate as a target optimization coefficient by the source driving chip, and optimizing the compensation signal according to the target optimization coefficient to obtain the data signal by the source driving chip.

The invention provides a signal processing method of a display panel, wherein the display panel includes a source driving chip and a timing control chip, the timing control chip is configured to provide a video signal to the source driving chip, and the source driving chip is configured to provide a data signal to the display panel, and wherein the signal processing method includes:

when a test data is obtained, adjusting the test data by the source driving chip using each preset optimization coefficient according to a preset adjustment instruction to obtain multiple adjusted data, wherein the test data corresponds to a pre-emphasis coefficient;

obtaining a bit error rate of each adjusted data by the source driving chip, to obtain multiple initial bit error rates, selecting one of the initial bit error rates as a feedback bit error rate from the multiple initial bit error rates by the source driving chip, determining whether the feedback bit error rate falls within a preset range or not by the timing control chip, and when the bit error rate exceeds the preset range, adjusting a current pre-emphasis coefficient by the timing control chip, and returning to and executing the step of when the test data is obtained, adjusting the test data by the source driving chip using each preset optimization coefficient according to the preset adjustment instruction to obtain the multiple adjusted data; and when the feedback bit error rate falls within the preset range, using the current pre-emphasis coefficient as a target pre-emphasis coefficient, and compensating the video signal according to the target pre-emphasis coefficient to obtain a compensation signal by the timing control chip.

The present invention also provides a signal processing device of a display panel, including:

an adjustment module configured to adjust a test data using each preset optimization coefficient according to a preset adjustment instruction to obtain multiple adjusted data when a test data is obtained, wherein the test data corresponds to a pre-emphasis coefficient;

an obtainment module configured to obtain a bit error rate of each adjusted data, to obtain multiple initial bit error rates;

a determination module configured to select one of the initial bit error rates as a feedback bit error rate from multiple initial bit error rates;

a judging module configured to determine whether the feedback bit error rate falls within a preset range or not;

a first processing module configured to adjust a current pre-emphasis coefficient when the bit error rate exceeds the preset range, and return to and execute the step of when the test data is obtained, adjusting the test data using each preset optimization coefficient according to the preset adjustment instruction, and when the feedback bit error rate falls within the preset range, using the current pre-emphasis coefficient as a target pre-emphasis coefficient, and compensating a video signal according to the target pre-emphasis coefficient to obtain a compensation signal.

In the method and device for processing signals of a display panel of the present invention, when obtaining a test data, adjusting the test data by the source driving chip using each preset optimization coefficient according to a preset adjustment instruction to obtain multiple adjusted data, obtaining the bit error rate of each adjusted data by the source driving chip to obtain multiple initial bit error rates, selecting one of the initial bit error rates from the multiple initial bit error rates as a feedback bit error rate by the source driving chip, determining whether the feedback bit error rate falls within a preset range or not by the timing control chip, and when the bit error rate exceeds the preset range, adjusting a current pre-emphasis coefficient by the timing control chip, and returning to and executing the step of when the test data is obtained, adjusting the test data by the source driving chip using each preset optimization coefficient according to the preset adjustment instruction to obtain the multiple adjusted data, when the feedback bit error rate falls within the preset range, using the current pre-emphasis coefficient as a target pre-emphasis coefficient, and compensating the video signal according to the target pre-emphasis coefficient to obtain a compensation signal by the timing control chip. Since the corresponding pre-emphasis coefficient is used to compensate the video signal while the bit error rate meets the preset requirements, thereby avoiding distortion of the signal and improving the display effect.

DETAILED DESCRIPTION OF EMBODIMENTS

Figure 1:
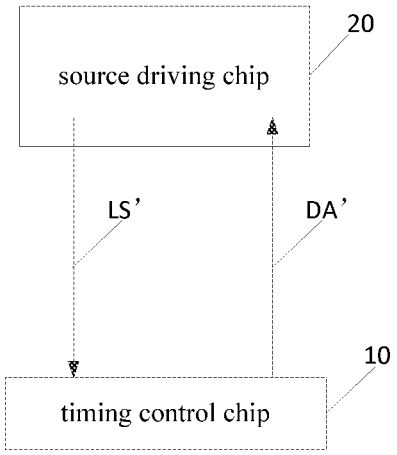
FIG. 1 is a schematic structural diagram of a conventional driving circuit.

The following description of each embodiment, with reference to the accompanying drawings, is used to exemplify specific embodiments which may be carried out in the present invention. Directional terms mentioned in the present invention, such as "top", "bottom", "front", "back", "left", "right", "inside", "outside", "side", etc., are only used with reference to the orientation of the accompanying drawings. Therefore, the used directional terms are intended to illustrate, but not to limit, the present invention. In the drawings, components having similar structures are denoted by the same numerals.

As shown in FIG. 1, a conventional timing control chip 10 is configured to provide a video signal to a source driving chip 20. The source driving chip 20 is configured to provide a data signal to a display panel. A data transmission channel DA' and a connection confirmation channel LS' are provided between the timing control chip and the source driving chip.

Figure 2:
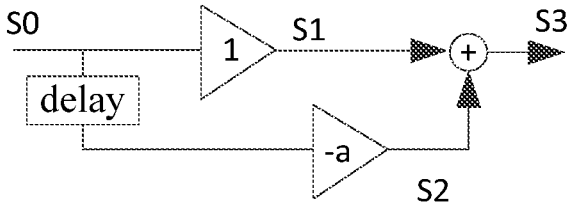
FIG. 2 is a schematic structural diagram of a first structure of a pre-emphasis module.
Figure 3:
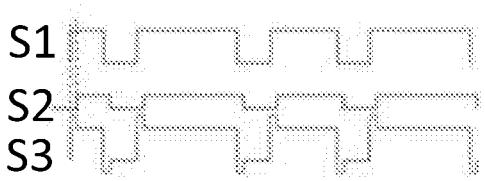
FIG. 3 is a waveform diagram of signals in the pre-emphasis module of FIG. 2.
Figure 4:
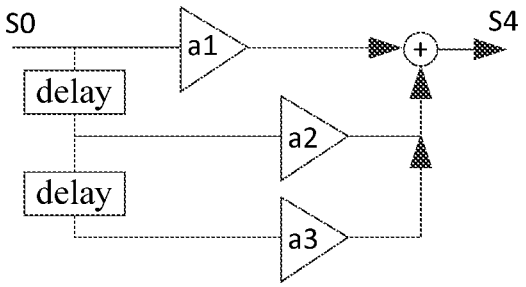
FIG. 4 is a schematic structural diagram of a second structure of the pre-emphasis module.

The timing control chip 20 includes a pre-emphasis module, and the pre-emphasis module is configured to provide multiple pre-emphasis coefficients. The pre-emphasis module delays and reverses an original signal, and performs an AND/OR operation with the original signal to obtain an output signal, as shown in FIGS. 2 to 4, in FIG. 2, where S0 represents the original signal and S1 represents an amplified signal, such as the magnification is 1 time, S2 represents a reverse signal, block −a represents a reverse amplification factor, and S3 and S4 are represent output signals. FIG. 3 shows a waveform of a signal in the pre-emphasis module of FIG. 2, the waveform between the two dotted lines indicates a delayed waveform. Blocks a1-a3 represent different amplification factors.

Figure 5:
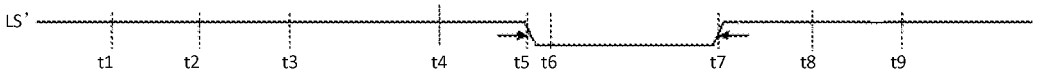
FIG. 5 is a waveform diagram of a conventional connection confirmation channel.

With reference to FIG. 1 and FIG. 5, the conventional connection confirmation channel LS' is a high-low transmission channel. If LS' is high, it indicates that the timing control chip and the source driving chip are successfully connected, and the timing control chip 10 transmits data to the source driving chip 20 normally; if LS' is low, it indicates that the timing control chip 10 and the source driving chip 20 are not successfully connected, and the timing control chip (TCON) 10 needs to send a clock training to the source driving chip continuously. At time t5, the timing control chip 10 is disconnected from the source driving chip 20. At time t7, the timing control chip 10 and the source driving chip 20 are re-established. Of course, the timing control chip 10 and the source driving chip 20 also have a data transmission channel DA'. In the periods of t1-t2, t3-t4, and t7-t8, the data transmission channel DA' transmits a preamble field, and in the periods of t2-t3, t4-t6, and t8-t9, the data transmission channel DA' transmits video signals.

Figure 6:
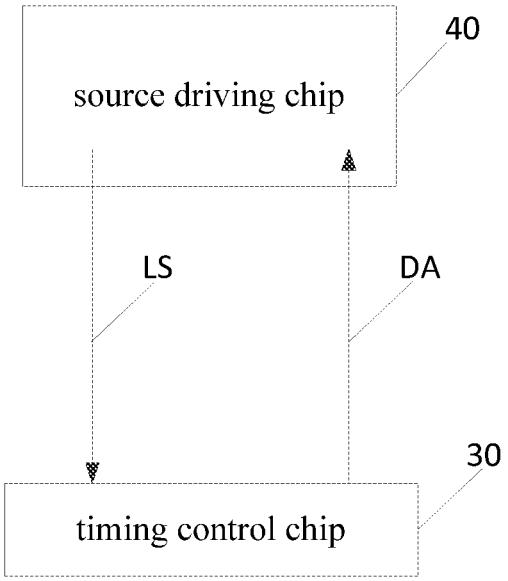
FIG. 6 is a schematic structural diagram of a driving circuit according to the present invention.

As shown in FIG. 6, a timing control chip 30 of the present invention is configured to provide a compensated video signal to a source driving chip 40. The source driving chip 40 is configured to provide a data signal to a display panel. The timing control chip 30 and the source driving chip 40 have a data transmission channel DA and a connection confirmation channel LS. The compensated video signal can be obtained by the following method.

The invention provides a signal processing method of a display panel, including the following.

S101, when a test data is obtained, adjusting the test data by the source driving chip using each preset optimization coefficient according to a preset adjustment instruction to obtain multiple adjusted data.

For example, the test data corresponds to a pre-emphasis coefficient, in one embodiment, the source driving chip 40 is provided with an equalizer (EQ). The equalizer has multiple batches, each batch corresponds to a different preset optimization coefficient. The preset optimization coefficient is configured to adjust the amplitude of the signal.

When the source driving chip 40 receives the preset adjustment instruction, when the source driving chip 40 receives the test data sent by the timing control chip 30, it uses each preset optimization coefficient to adjust the test data to obtain multiple adjusted data, such as the source driving chip 40 automatically adjusts the EQ batches to adjust the preset optimization coefficient. In one embodiment, for example, the preset adjustment instruction is provided by the timing control chip 30.

S102, obtaining a bit error rate of each adjusted data, and obtaining multiple initial bit error rates.

For example, the source driving chip 40 obtains the bit error rate of each of the adjusted data described above to obtain the multiple initial bit error rates.

In an embodiment, the step of obtaining the bit error rate of each adjusted data can include:

S1021, obtaining difference data between the adjusted data and the test data; and

S1022, obtaining the bit error rate of the adjusted data according to the difference data.

For example, in an embodiment, the source driving chip 40 compares the adjusted data with the test data to obtain the difference data between the two, and then calculates the percentage of the difference data in the test data to obtain the bit error rate of the adjusted data.

S103, selecting one of the multiple initial bit error rates as a feedback bit error rate.

For example, the source driving chip 40 selects one of the initial bit error rates as the feedback bit error rate from the multiple initial bit error rates.

To further avoid signal distortion, the step of selecting one of the initial bit error rates as the feedback bit error rate from multiple initial bit error rates includes:

S1031, obtaining a minimum value from the multiple initial bit error rates to obtain a minimum bit error rate; and

S1032, using the minimum bit error rate as the feedback bit error rate.

For example, the source driving chip 40 uses the minimum value from the multiple initial bit error rates as the feedback bit error rate.

S104, determining whether the feedback bit error rate falls within a preset range or not.

The timing control chip 30 determines whether the feedback bit error rate falls within the preset range or not, when the bit error rate exceeds the preset range, a step S105 is performed, and when the feedback bit error rate falls within the preset range, a step S106 is performed.

S105, when the bit error rate exceeds the preset range, adjusting a current pre-emphasis coefficient, and returning to and executing the step of when the test data is obtained, adjusting the test data using each preset optimization coefficient according to the preset adjustment instruction to obtain the multiple adjusted data.

For example, the timing control chip 30 has a pre-emphasis function, that is, it has multiple pre-emphasis batches, and each batch corresponds to a different pre-emphasis coefficient. The preset emphasis coefficient is configured to adjust an emphasis strength of the signal. When the bit error rate exceeds the preset range, adjusting the current pre-emphasis coefficient, and returning to the step S101. In one embodiment, the preset emphasis coefficient can be gradually increased. Of course, the preset emphasis coefficient can be gradually reduced.

S106, when the feedback bit error rate falls within the preset range, using the current pre-emphasis coefficient as a target pre-emphasis coefficient, and compensating a video signal according to the target pre-emphasis coefficient to obtain a compensation signal.

For example, when the feedback bit error rate falls within the preset range, the timing control chip 30 uses the current pre-emphasis coefficient as the target pre-emphasis coefficient, and compensates the video signal according to the target pre-emphasis coefficient to obtain the compensation signal.

The method can further include:

S107, when the feedback bit error rate falls within the preset range, using the preset optimization coefficient corresponding to the feedback bit error rate as a target optimization coefficient.

For example, when the feedback bit error rate falls within the preset range, the source driving chip 40 uses the preset optimization coefficient corresponding to the feedback bit error rate as the target optimization coefficient.

S108, optimizing the compensation signal according to the target optimization coefficient to obtain a data signal.

For example, the source driving chip 40 optimizes the compensation signal according to the target optimization coefficient to obtain the data signal. The data signal is configured to input to a display panel for screen display.

In an embodiment, before the step of determines whether the feedback bit error rate falls within the preset range or not, the method can further include:

S104', the source driving chip 40 fed back the feedback bit error rate to the timing control chip 30.

For example, the source driving chip 40 feeds back the feedback bit error rate to the timing control chip 30 so that the timing control chip 30 determines whether the feedback bit error rate falls within the preset range.

Figure 7:
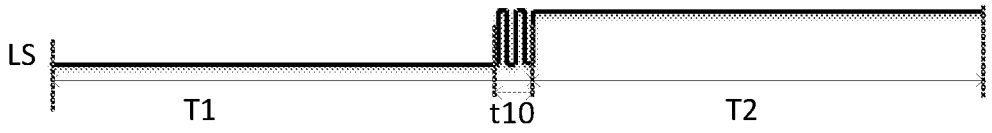
FIG. 7 is a waveform diagram of a connection confirmation channel according to the present invention.

In an embodiment, as shown in FIG. 7, the source driving chip 40 and the timing control chip 30 have a connection confirmation channel LS disposed therebetween, the connection confirmation channel LS is configured to characterize whether the source driving chip 40 is successfully connected to the timing control chip 30; and the source driving chip 40 sends the feedback bit error rate to the timing control chip 30 through the connection confirmation channel. Because the bit error rate is transmitted through the existing channel, it is avoided to reset the timing control chip and the source driving chip, thereby reducing the production cost. Of course, it can be understood that the transmission mode of the feedback bit error rate is not limited thereto.

When the connection confirmation channel LS is in a first state (T1 stage), the source driving chip 40 sends the feedback bit error rate to the timing control chip 30. When the connection confirmation channel LS is in the first state, the source driving chip 40 and the timing control chip 30 are not connected successfully. For example, in a period of t10, the source driving chip 40 can convert the feedback bit error rate into a digital signal, and then send the digital signal to the timing control chip 30 through the LS.

When the connection confirmation channel LS is in a second state (T2 stage), the source driving chip 40 is successfully connected to the timing control chip 30, and the timing control chip 30 sends the compensation to the source driving chip 40 signal.

Preferably, in the period of t10, the data transmission channel DA is configured to transmit the test data and the compensation signal.

In a specific embodiment, a timing control chip (TCON) adds an adjustment instruction, a "CMD" instruction is transmitted through the data transmission channel DA, and TCON sends a logic "0", at which time the differential pair is low (|CSPI_P−CSPI_N|=L), the source driving chip 40 (driver IC) receives the CMD instruction and starts scanning each EQ batch.

At the same time, TCON adds test data (scramble data). The test data is generated according to preset rules, specifically, an ISI effect value in the test data is detected to judge the signal quality of the test data.

Figure 8:
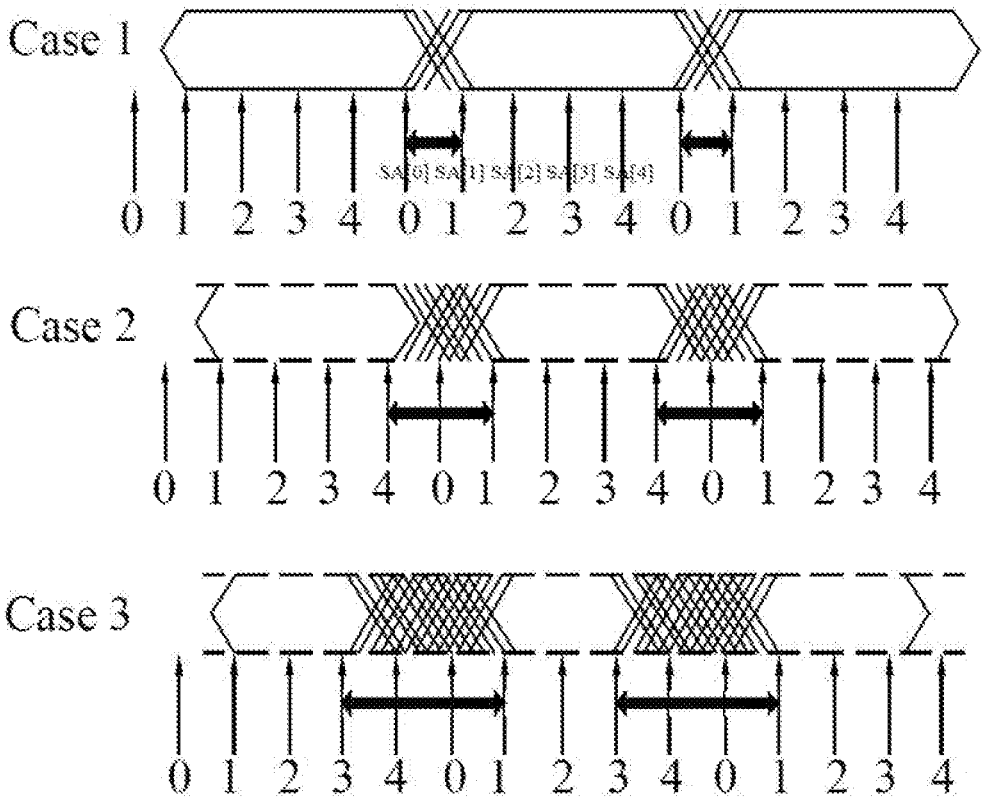
FIG. 8 is a waveform diagram of test data of different qualities.

As shown in FIG. 8, numbers 0-4 at the bottom of FIG. 8 indicate the sampling numbers, which means different sampling times. Case1-case3 represent test data of three different quality, each of which includes D0-D3 data segments, SA [1]-SA [4] represent sampling data, and the detection results are shown in table 1.

TABLE 1

| Signal | sample data | ISI effect value |
|---|---|---|
| Case 1 | SA[2]=SA[3]=SA[4] | Low |
| Case 2 | SA[2]=SA[3]≠SA[4] | Medium |
| Case 3 | SA[2]≠SA[3]≠SA[4] | High |

It can be seen that the ISI effect value of case1 is lower and the quality is better. The ISI effect value of case2 is in the middle, and the quality is average. The case3 has a higher ISI effect value and the worst quality.

The driver IC is equipped with n bit equalizer filter (EQ filter) with a total of $2^n$ batches, where n is a natural number. When entering the adjustment of the EQ batches, determining the bit error rate of the test data of each batch, and using a minimum value of the multiple bit error rates as an optimal bit error rate. If number of N all are optimal bit error rates, the middle batch among the batches corresponding to the optimal bit error rates is taken as the best batch. At the same time, the driver IC feeds back the optimal bit error rate to the TCON through the LS channel.

After the TCON receives the bit error rate fed back by the driver IC, the TCON increases the pre-emphasis batch according to the bit error rate step by step until the bit error rate fed back by the driver IC reaches an acceptable range.

Specifically, the transmitting terminal is the TCON, the receiving terminal is the driver IC, an initial pre-emphasis batch of the transmitting terminal is 0, the transmitting terminal sends adjustment instructions and test data, and the receiving terminal starts to scan the EQ batch automatically to find the minimum bit error rate. The minimum bit error rate is fed back to the transmitting terminal, and the transmitting terminal determines whether the feedbacked bit error rate falls within the preset range or not.

If yes, the EQ batch corresponding to the bit error rate is directly used as a final EQ batch, and the pre-emphasis batch is used as a final pre-emphasis batch.

If not, the transmitting terminal retransmits the test data, and the receiving terminal scans the EQ batch again to find the minimum bit error rate, feeds back the minimum bit error rate to the transmitting terminal, and repeats the above steps until the transmitting terminal determines that the bit error rate falls within the preset range. Of course, if the feedback bit error rate is still not within the preset range when the transmitting terminal has been adjusted to the maximum pre-emphasis batch, stop the adjustment, using the current pre-emphasis batch as the final pre-emphasis batch, and using the current EQ batch as the final EQ batch.

Figure 9:
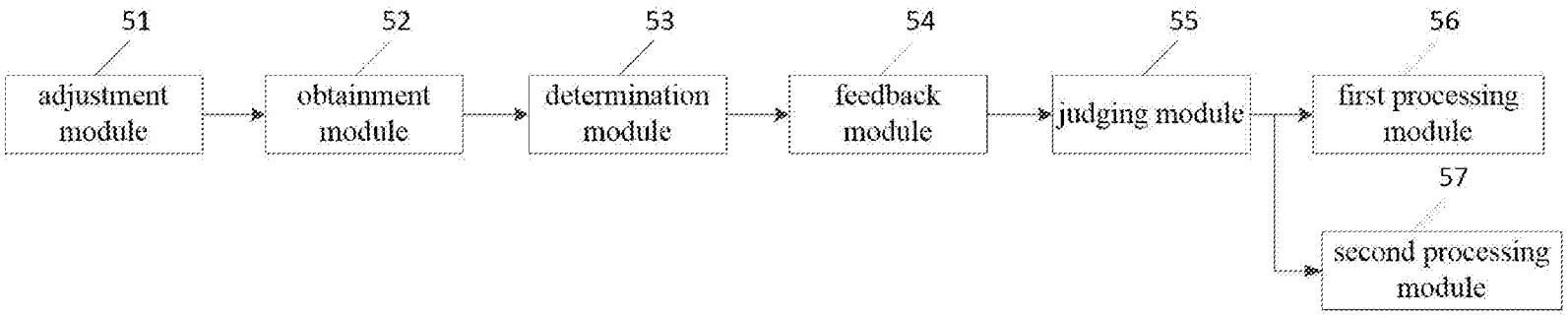
FIG. 9 is a schematic structural diagram of a signal processing device of a display panel of the present invention.

As shown in FIG. 9, the present invention further provides a signal processing device of a display panel, including the following.

An adjustment module 51 is configured to adjust test data using each preset optimization coefficient according to a preset adjustment instruction to obtain multiple adjusted data when the test data is obtained, wherein the test data corresponds to a pre-emphasis coefficient.

An obtainment module 52 is configured to obtain a bit error rate of each adjusted data to obtain multiple initial error rates.

A determination module 53 is configured to select one of the initial bit error rates from the multiple initial bit error rates as a feedback bit error rate.

The device can further include a feedback module 54 that is configured to feed back the feedback bit error rate to the timing control chip by the source driving chip before the step of determining whether the feedback bit error rate falls within the preset range or not.

A judging module 55 is configured to determine whether the feedback bit error rate falls within the preset range or not.

A first processing module 56 is configured to adjust a current pre-emphasis coefficient when the bit error rate exceeds the preset range, and returning to and executing the step of when the test data is obtained, adjusting the test data using each preset optimization coefficient according to the preset adjustment instruction; when the feedback bit error rate falls within the preset range, using the current pre-emphasis coefficient as a target pre-emphasis coefficient, and compensating a video signal according to the target pre-emphasis coefficient to obtain a compensation signal.

The device can further include a second processing module 57 that is configured to use the preset optimization coefficient corresponding to the feedback bit error rate as a target optimization coefficient when the feedback bit error rate falls within the preset range, and optimize the compensation signal according to the target optimization coefficient to obtain the data signal.

The determination module 53 is specifically configured to obtain a minimum value of multiple initial bit error rates to obtain a minimum bit error rate, and use the minimum bit error rate as a feedback bit error rate.

The obtainment module 53 is specifically configured to obtain difference data between the adjusted data and the test data, and obtain a bit error rate of the adjusted data according to the difference data to obtain the multiple initial bit error rates.

Understandably, the adjustment module, the obtainment module, the determination module, and the feedback module can be integrated in the source driving chip, and the judging module, the first processing module, and the second processing module can be integrated in the timing control chip.

In the method and device for processing signals of a display panel of the present invention, when obtaining a test data, the source driving chip adjusts the test data using each preset optimization coefficient according to a preset adjustment instruction to obtain multiple adjusted data. The source driving chip obtains the bit error rate of each adjusted data to obtain multiple initial bit error rates. The source driving chip selects one of the initial bit error rates from the multiple initial bit error rates as a feedback bit error rate. The timing control chip determinates whether the feedback bit error rate falls within a preset range or not. When the bit error rate exceeds the preset range, the timing control chip adjusts a current pre-emphasis coefficient, and returns to execute step of when the test data is obtained, the source driving chip adjusts the test data using each preset optimization coefficient according to the preset adjustment instruction to obtain the multiple adjusted data. When the feedback bit error rate falls within the preset range, the timing control chip uses the current pre-emphasis coefficient as a target pre-emphasis coefficient, and compensates the video signal according to the target pre-emphasis coefficient to obtain a compensation signal. Since the corresponding pre-emphasis coefficient is used to compensate the video signal while the bit error rate meets the preset requirements, thereby avoiding distortion of the signal and improving the display effect.

Embodiments of the present invention have been described, but not intended to impose any unduly constraint to the appended claims. For a person skilled in the art, any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A signal processing method for a display panel, wherein the display panel comprises a source driving chip and a timing control chip, the timing control chip is configured to provide a video signal to the source driving chip, and the source driving chip is configured to provide a data signal to the display panel, and wherein the signal processing method comprises:

when a test data is obtained, adjusting the test data by the source driving chip using each preset optimization coefficient according to a preset adjustment instruction to obtain a plurality of adjusted data, wherein the test data corresponds to a pre-emphasis coefficient;

obtaining a bit error rate of each adjusted data by the source driving chip, to obtain a plurality of initial bit error rates, selecting one of the plurality of initial bit error rates as a feedback bit error rate multiple initial bit error rates by the source driving chip, feeding back the feedback bit error rate to the timing control chip by the source driving chip, determining whether the feedback bit error rate falls within a preset range or not by the timing control chip, and when the feedback bit error rate exceeds the preset range, adjusting a current pre-emphasis coefficient by the timing control chip, and returning to and executing the step of when the test data is obtained, adjusting the test data by the source driving chip using each preset optimization coefficient according to the preset adjustment instruction to obtain the plurality of adjusted data;

when the feedback bit error rate falls within the preset range, using the current pre-emphasis coefficient as a target pre-emphasis coefficient, and compensating the video signal according to the target pre-emphasis coefficient to obtain a compensation signal by the timing control chip; and when the feedback bit error rate falls within the preset range, using the preset optimization coefficient corresponding to the feedback bit error rate as a target optimization coefficient by the source driving chip, and optimizing the compensation signal according to the target optimization coefficient to obtain the data signal by the source driving chip.

2. The signal processing method for the display panel of claim 1, wherein the step of selecting one of the plurality of initial bit error rates as the feedback bit error rate by the source driving chip comprises:

obtaining a minimum value among the plurality of initial bit error rates by the source driving chip to obtain a minimum bit error rate; and using the minimum bit error rate as the feedback bit error rate by the source driving chip.

3. The signal processing method for the display panel of claim 1, wherein the step of obtaining the bit error rate of each adjusted data by the source driving chip comprises:

obtaining difference data between the adjusted data and the test data by the source driving chip; and obtaining the bit error rate of the adjusted data according to the difference data to obtain the plurality of initial bit error rates by the source driving chip.

4. The signal processing method for the display panel of claim 1, wherein a connection confirmation channel is provided between the source driving chip and the timing control chip, and the connection confirmation channel is configured to characterize whether the source driving chip is successfully connected to the timing control chip or not; and wherein the source driving chip sends the feedback bit error rate to the timing control chip through the connection confirmation channel.

5. The signal processing method for the display panel of claim 4, wherein when the connection confirmation channel is in a first state, the source driving chip sends the feedback bit error rate to the timing control chip; and when the connection confirmation channel is in a second state, the timing control chip sends the compensation signal to the source driving chip.

6. The signal processing method for the display panel of claim 1, wherein a data transmission channel is provided between the source driving chip and the timing control chip, and the data transmission channel is configured to transmit the test data and the compensation signal.

7. A signal processing method for a display panel, wherein the display panel comprises a source driving chip and a timing control chip, the timing control chip is configured to provide a video signal to the source driving chip, and the source driving chip is configured to provide a data signal to the display panel, and wherein the signal processing method comprises:

when a test data is obtained, adjusting the test data by the source driving chip using each preset optimization coefficient according to a preset adjustment instruction to obtain a plurality of adjusted data, wherein the test data corresponds to a pre-emphasis coefficient;

obtaining a bit error rate of each adjusted data by the source driving chip, to obtain a plurality of initial bit error rates, selecting one of the plurality of initial bit error rates as a feedback bit error rate by the source driving chip, determining whether the feedback bit error rate falls within a preset range or not by the timing control chip, and when the feedback bit error rate exceeds the preset range, adjusting a current pre-emphasis coefficient by the timing control chip, and returning to and executing the step of when the test data is obtained, adjusting the test data by the source driving chip using each preset optimization coefficient according to the preset adjustment instruction to obtain the plurality of adjusted data; and when the feedback bit error rate falls within the preset range, using the current pre-emphasis coefficient as a target pre-emphasis coefficient, and compensating the video signal according to the target pre-emphasis coefficient to obtain a compensation signal by the timing control chip.

8. The signal processing method for the display panel of claim 7, wherein the signal processing method further comprises:

when the feedback bit error rate falls within the preset range, using the preset optimization coefficient corresponding to the feedback bit error rate as a target optimization coefficient by the source driving chip, and optimizing the compensation signal according to the target optimization coefficient to obtain the data signal by the source driving chip.

9. The signal processing method for the display panel of claim 7, wherein the step of selecting one of the plurality of initial bit error rates as the feedback bit error rate by the source driving chip comprises:

obtaining a minimum value among the plurality of initial bit error rates by the source driving chip to obtain a minimum bit error rate, and using the minimum bit error rate as the feedback bit error rate by the source driving chip.

10. The signal processing method for the display panel of claim 7, wherein the step of obtaining the bit error rate of each adjusted data by the source driving chip comprises:

obtaining difference data between the adjusted data and the test data by the source driving chip; and obtaining the bit error rate of the adjusted data according to the difference data to obtain the plurality of initial bit error rates by the source driving chip.

11. The signal processing method for the display panel of claim 7, wherein before the step of determining whether the feedback bit error rate falls within the preset range or not by the timing control chip, the signal processing method further comprises:

feeding back the feedback bit error rate to the timing control chip by the source driving chip.

12. The signal processing method for the display panel of claim 11, wherein a connection confirmation channel is provided between the source driving chip and the timing control chip, and the connection confirmation channel is configured to characterize whether the source driving chip is successfully connected to the timing control chip or not; and wherein the source driving chip sends the feedback bit error rate to the timing control chip through the connection confirmation channel.

13. The signal processing method for the display panel of claim 12, wherein when the connection confirmation channel is in a first state, the source driving chip sends the feedback bit error rate to the timing control chip; and when the connection confirmation channel is in a second state, the timing control chip sends the compensation signal to the source driving chip.

14. The signal processing method for the display panel of claim 7, wherein a data transmission channel is provided between the source driving chip and the timing control chip, and the data transmission channel is configured to transmit the test data and the compensation signal.

15. A signal processing device in a display panel configured to execute a method, the method comprising:

adjusting a test data using each preset optimization coefficient according to a preset adjustment instruction to obtain a plurality of adjusted data when the test data is obtained, wherein the test data corresponds to a pre-emphasis coefficient;

obtaining a bit error rate of each adjusted data to obtain a plurality of initial bit error rates;

selecting one of the plurality of initial bit error rates as a feedback bit error rate;

determining whether the feedback bit error rate falls within a preset range or not; and adjusting a current pre-emphasis coefficient when the feedback bit error rate exceeds the preset range, and returning to and executing the step of when the test data is obtained, adjusting the test data using each preset optimization coefficient according to the preset adjustment instruction, and when the feedback bit error rate falls within the preset range, using the current pre-emphasis coefficient as a target pre-emphasis coefficient, and compensating a video signal according to the target pre-emphasis coefficient to obtain a compensation signal.

16. The signal processing device in the display panel configured to execute the method of claim 15, the method further comprising: using the preset optimization coefficient corresponding to the feedback bit error rate as a target optimization coefficient when the feedback bit error rate falls within the preset range, and optimize the compensation signal according to the target optimization coefficient to obtain a data signal.

17. The signal processing device in the display panel configured to execute the method of claim 15, wherein the step of selecting one of the plurality of initial bit error rates as the feedback bit error rate comprises obtaining a minimum value among the plurality of initial bit error rates to obtain a minimum bit error rate, and using the minimum bit error rate as the feedback bit error rate.

18. The signal processing device in the display panel configured to execute the method of claim 15, wherein the step of obtaining the bit error rate of each adjusted data comprises obtaining difference data between the adjusted data and the test data, and obtaining the bit error rate of the adjusted data according to the difference data to obtain the plurality of initial bit error rates.

19. The signal processing device in the display panel configured to execute the method of claim 15, the method further comprising feeding back the feedback bit error rate to a timing control chip by a source driving chip before the step of determining whether the feedback bit error rate falls within the preset range or not.

20. The signal processing device in the display panel configured to execute the method of claim 19, the signal processing device further comprising a connection confirmation channel provided between the source driving chip and the timing control chip, wherein the connection confirmation channel is configured to characterize whether the source driving chip is successfully connected to the timing control chip or not; and the source driving chip sends the feedback bit error rate to the timing control chip through the connection confirmation channel.

* * * * *